United States Patent [19]

Turner

[11] Patent Number: 5,048,251

[45] Date of Patent: Sep. 17, 1991

[54] DIVIDED LIGHT DOOR

[75] Inventor: Terry A. Turner, Prineville, Oreg.

[73] Assignee: Tru-Line Manufacturing, Redmond, Oreg.

[21] Appl. No.: 484,279

[22] Filed: Feb. 26, 1990

[51] Int. Cl.[5] ..... E06B 3/70

[52] U.S. Cl. ..... 52/456

[58] Field of Search ..... 52/455, 456, 668

[56] References Cited

U.S. PATENT DOCUMENTS

| | | | |
|---|---|---|---|
| 2,069,391 | 2/1937 | Sample | 52/668 |
| 2,132,217 | 10/1938 | Neuendorf | 52/455 X |
| 2,137,439 | 11/1938 | Bayley | 52/456 X |
| 2,241,952 | 2/1941 | Lachman | 52/668 |
| 3,099,865 | 8/1963 | Burnett | 52/456 X |
| 3,293,817 | 12/1966 | MacGregor | 52/456 |
| 4,060,950 | 12/1977 | Rackard et al. | 52/668 X |
| 4,387,545 | 6/1983 | Kern | 52/455 |
| 4,610,901 | 9/1986 | Linscott | 52/456 X |
| 4,825,615 | 5/1989 | Turner | 52/656 X |
| 4,845,911 | 7/1989 | Winston et al. | 52/456 |
| 4,860,517 | 8/1989 | Kipross | 52/456 X |

*Primary Examiner*—David A. Scherbel
*Assistant Examiner*—Lan Mai
*Attorney, Agent, or Firm*—Kolisch, Hartwell, Dickinson McCormack & Heuser

[57] ABSTRACT

A divided light door which includes an integrated core panel and a lattice frame mounted in a frame-receiving opening provided in the core panel. The lattice frame includes inner frame pieces extending across each other and interlocked with each other. Veneer pieces covering the core panel and edge band strips form the faces of the door.

7 Claims, 1 Drawing Sheet

DIVIDED LIGHT DOOR

BACKGROUND AND SUMMARY OF THE INVENTION

This invention relates to a construction for a door or similar structure, and more particularly to what is known in the industry as a divided light door. In such a door, light transmitting panels, usually panes of glass, are mounted in respective ones of a plurality of rectangular openings provided in the door. The door described is to be compared with another type of light door, which might be described as including an enlarged pane of glass with a lattice type overlay on each side serving to impart to the door the appearance of a multiplicity of panes instead of one single pane. For a variety of reasons, a divided light door has been a more popular door than the door just described.

In a divided light door of conventional construction, elongate stile members are fitted against and secured to the ends of transversely extending rail members. The stile and rail members collectively extending about a generally open area which is broken up by horizontally and vertically extending interior frame members which break up this open area into openings to receive the panes of glass. These interior frame members frequently are mounted in such a way that requires that the inner frame members first be pre-assembled and that the stile and rail members then be brought together about the pre-assembled inner frame members. The construction is not one which permits the use of an integrated core panel in the door, such as a core panel formed of veneer layers extending across each other in corner regions of the core panel with these layers being adhesively secured together to impart considerable strength at these corner regions. Because of the integrated nature of the core panel, a door constructed with such a panel has substantial strength and will not sag or otherwise distort over time, with separation, for instance, of stiles and rails in the door as is experienced with conventional doors.

A general object of this invention is to provide an improved divided light door which features a lattice frame which includes a band of material extending about the perimeter of the frame bounding a generally open area. This open area is broken up into panel-receiving openings by elongate inner frame pieces crossed with each other and having ends joined to the band of material. The lattice frame is constructed so as to be fittable within a frame-receiving opening bounded by vertical and horizontally extending expanses of an integrated core panel.

More specifically, it is contemplated that the band of material be made of end-to-end disposed edge band strips having flat outer surfaces disposed generally normal to the plane of the lattice frame. In this way, the frame after being assembled can be moved bodily and with relative lateral shifting into an opening in the core panel which has edge surfaces defining the opening parallelling the surfaces of the edge band strips.

Oak is a commonly used wood in the manufacture of a divided light door. As contemplated by this invention, the integrated core panel may be overlaid with oak veneer, and the lattice frame described be made of interfitted edge band strips and inner frame pieces all prepared from oak. If the edge band strips and inner frame pieces are cut to have a special contouring extending along a side thereof, such can add considerable expense to a door, given the fact that a material such as high quality oak is in short supply. When it is remembered that a door manufacturer might use one thickness of glass in supplying one customer, and another thickness for another customer, and that the contours of specially cut frame pieces will vary depending upon the glass thickness selected, the expense of having special contouring extending along a side is magnified. This is because the door manufacturer is required to store a large inventory which will accommodate different customer selections. In a more specific sense, this invention contemplates a door construction wherein the lattice frame throughout is made of uniformally sized, flat-sided strips crossing each other, and collectively defining panel-receiving openings. Panes are mounted within these openings by molding strips disposed on opposite sides of panes which are separate from and not a part of the main frame members.

It is further contemplated that the inner frame pieces described have ends joined through mortise and tenon joints with the edge band strips which form the band extending about the perimeter of the frame. Further, the frame pieces where they cross each other, are interconnected by an interfitting joint comprising rectangular cutouts and conforming webs in the pieces.

BRIEF DESCRIPTION OF THE DRAWINGS

These and other objects and advantages will become more fully apparent as the following description is read in conjunction with the accompanying drawings, wherein.

DETAILED DESCRIPTION OF A PREFERRED EMBODIMENT

Figure 1:
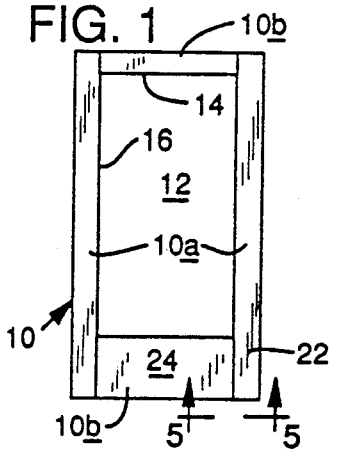
FIG. 1 illustrates a core panel used in making the door of the invention.

Referring now to the drawings, illustrated in FIG. 1 is what is referred to herein as an integrated core panel given the reference number 10. The core panel is rectangular in outline, and has inwardly of its margins a rectangular frame-receiving opening shown at 12. Bounding this opening are vertical expanses **10*a* of the core panel, and horizontal expanses 10*b*. These horizontal and vertical expanses are bounded by edge surfaces 14, 16 which delineate the frame-receiving opening 12** and which lie in planes extending generally normal to the plane of the core panel.

The core panel may be made of a relatively available material such as plywood. This material conventionally is made up of multiple veneer layers stacked one over the other, usually with cross-banding, and adhesively secured to each other. The plywood is assembled in the core piece in such a manner that at corner regions, i.e., those regions where a horizontal and vertical expanse merge, veneer layers which are continuation of a horizontal expanse are sandwiched between layers which are a continuation of a vertical expanse. In this way, there is integration of the panel which inhibits sagging and other distortions of the panel during the life of the door.

Figure 5:
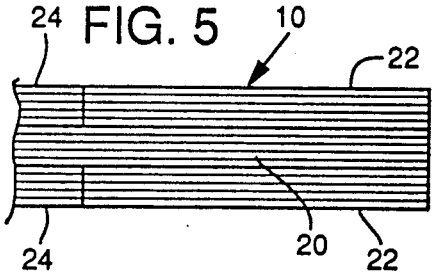
FIG. 5 is a view taken generally along the line 5—5 in FIG. 1.

Further explaining, and considering both FIGS. 1 and FIG. 5, the core panel may be made to have an elongate plywood segment 20 extending along the base of the core panel and throughout the entire width of the core panel. Elongate plywood segments 22 extend along the entire height of the core panel along a vertical expanse of the core panel. At the lower right hand corner of the core panel, these plywood segments overlap and extend across an end in plywood segment 20. Plywood segments 24 overlie plywood segment 20 and extend across the width of the door a distance equalling the width of opening 12. The various plywood segments which make up the door are adhesively secured together in a conventional manner.

Figure 2:
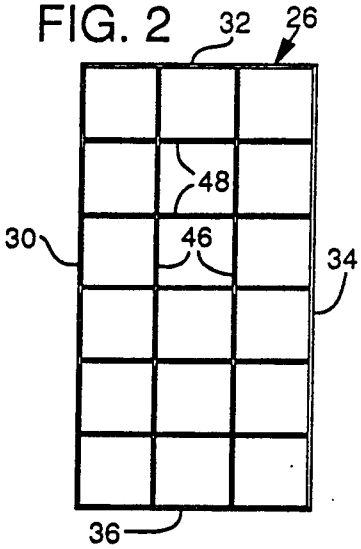
FIG. 2 illustrates on a somewhat larger scale a lattice frame pre-assembled and ready for mounting in the core panel.
Figure 3:
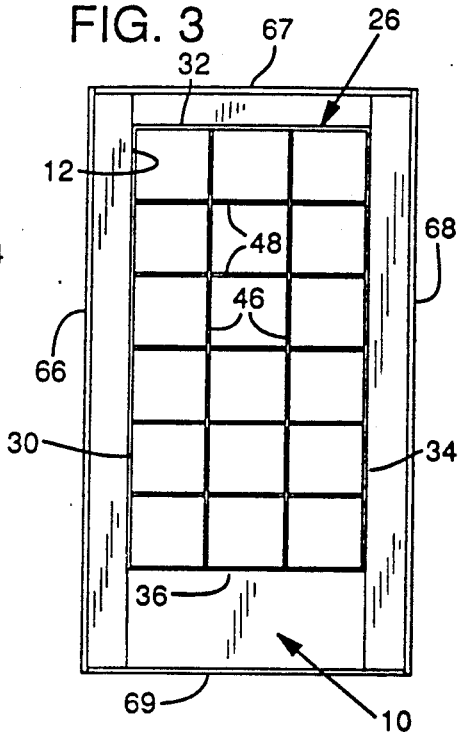
FIG. 3 illustrates the lattice frame of FIG. 2 mounted within a core panel, and further shows edge band strips applied about the perimeter of the panel.

Illustrated in FIG. 2 is what is referred to herein as a lattice frame, shown at 26. The lattice frame is rectangular in outline. The outer dimensions of the frame are such that the frame may be pre-assembled, as shown in FIG. 2, and as pre-assembled then inserted into frame-receiving opening 12 of the core panel by sliding the frame laterally into the opening. Core panel 10 is shown on a slightly larger scale in FIG. 3 than as illustrated in FIG. 1, and in FIG. 3 frame 26 has been mounted within opening 12.

Figure 4:
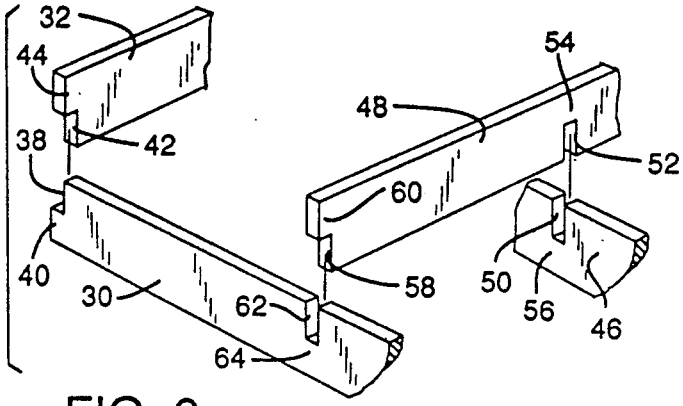
FIG. 4 is an enlarged perspective view of portions of the lattice frame and showing how such is constructed.

Describing in more detail the construction of the lattice frame, the perimeter of the frame is formed by a series of edge band strips 30, 32, 34 and 36 disposed end-to-end thus to form a continuous band of material. Edge band strips 30, 34 are vertical strips and edge band strips 32, 36 are horizontal strips. The strips have a width conforming to the thickness of core panel 10. The strips have opposite flat sides and these sides generally occupy planes normal to the general plane of the lattice frame. Ends of the strips are joined in the manner shown in FIG. 4 wherein a cutout 38 in strip 30 leaves a tenon 40 and a cutout 42 in strip 32 leaves a tenon 44. The cutout in one strip conforms to the tenon in the other, enabling the mortise and tenons to interfit and to produce a corner joint where opposite edges of strip 30 are in registry with opposite edges of strip 32.

The edge band strips bound a generally open area. This open area is divided into multiple panel-receiving openings by elongate inner frame pieces crossed with each other, as exemplified by vertical pieces 46 and horizontal pieces 48.

These pieces, like the edge band strips 30, 32, 34, and 36, may have flat opposite sides, and a width and thickness conforming to the width and thickness of the edge band strips. By having the same dimensions, advantages are realized, since this reduces the inventory required by a door manufacturer. The inner frame pieces are connected to each other by an interfitting joint where they cross with each other. An interfitting joint also connects the ends of the inner frame pieces with the edge band strips. Specifically, and again referring to FIG. 4 where a vertical and horizontal piece cross the two pieces have cutouts shown at 50, 52, conforming in size to remaining webs 54, 56. Cutout 50 receives web 54 and cutout 52 receiving web 56. After interfitting, the two pieces have opposite margins in registry with each other. At the end of an inner frame piece, where such meets with an edge band strip, the joint includes a cutout 58 leaving a tenon 60 and a cut-out 62 leaving a web 64 enabling interfitting in a manner, similar to the interfitting at adjacent ends of the edge band strips.

The lattice frame so constructed may be snugly fitted within the frame-receiving opening of the core panel. After such fitting, and proper securement in place, as with fasteners, the lattice frame and core panel extend in the same plane with opposite sides of these structures flush with each other.

Prior to applying veneer overlays, edge band strips 66, 67, 68, and 69 are applied about the perimeter of the core panel. These strips, like strips 30, have the same width as the core panel. With these strips secured in place, veneer strips, such as those shown at 72, 74, 76, 78, in FIG. 6 may be adhesively secured to each of opposite sides of the core panel, these strips also covering the edge band strips which surround the core panel and which form the outer band of the lattice frame.

Figure 6:
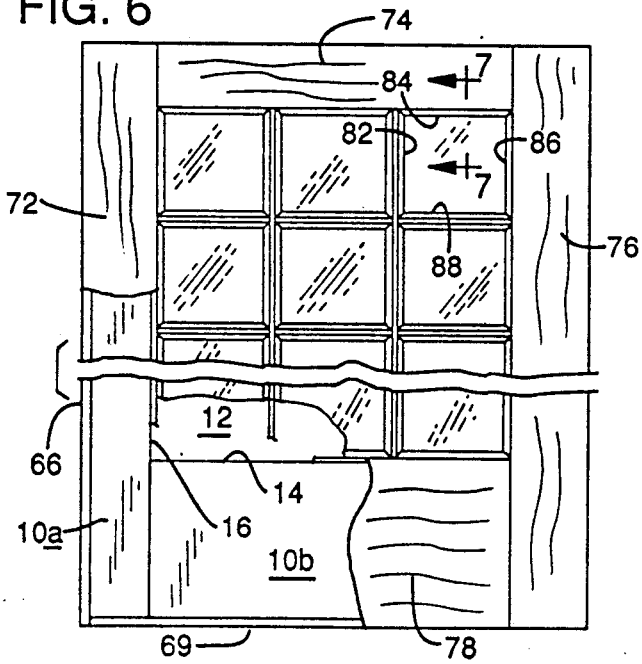
FIG. 6 is a view, on a somewhat larger scale than the scale of FIG. 3, and with portions broken away, illustrating a completed door.
Figure 7:
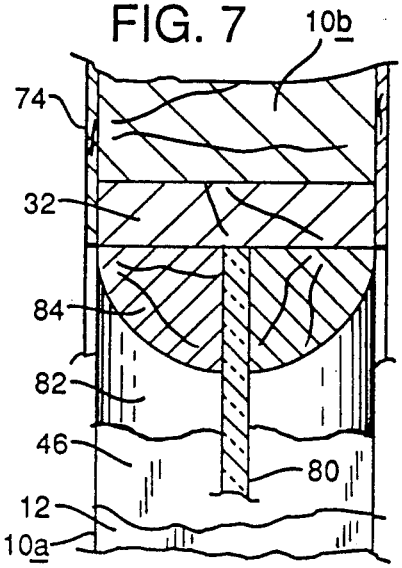
FIG. 7 is a cross-sectional view, on an even a larger scale, taken generally along the line 7—7 in FIG. 6.

In mounting a light-transmitting panel such as a glass pane, in each of the panel-receiving openings defined by the inner frame members, strips of moldings are used secured as by nailing to the material which surrounds the panel-receiving opening. Thus, as shown in FIGS. 6 and 7, pane 80 is mounted in place with molding strips 82, 84, 86, 88 on one side of the pane, and similar molding strips including strip 90 on the opposite side of the pane.

It will be noted that by using sets of molding strips on each of opposite sides of the pane, it is a relatively easy matter to accommodate the desire of different customers for different pane thicknesses in their different doors. Thus, to accommodate a somewhat thicker pane, the molding strips utilized to support the pane have a slightly lesser width than the ones illustrated, and conversely, with a thinner pane, the molding strips would have a slightly greater width.

With it possible to use a standard size strip of wood for all the components of the lattice frame, a manufacturer's inventory requirements are lessened. Economies are also realized because the wood pieces used in the lattice frame require no special millwork in their manufacture.

A door constructed as contemplated has a very pleasing appearance, closely resembling a conventional style and rail type door. The lattice frame which divides the interior of the door into different spaces for receiving the panes or light-transmitting panels has considerable strength in comparison to comparable structures in prior known divided light doors. The integrated nature of the core panel results in a the door which will not evidence sagging or distortion after many years of service.

While a specific embodiment of the invention has been described, obviously modifications and variations are possible without departing from the invention.

It is claimed and desired to secure by Letters Patent:

1. In a door or similar structure that extends generally in a plane:

a lattice frame comprising multiple edge band strips disposed end-to-end and collectively forming a band of material extending about the perimeter of the lattice frame and bounding a generally open area, and multiple elongate inner frame pieces crossed with each other and having ends joined with said band of material, said pieces dividing said open area into multiple panel-receiving openings, a light-transmitting panel mounted in respective ones of said panel-receiving openings, and an integrated core panel mounting said lattice frame, said core panel having a frame-receiving opening and said opening snugly receiving the lattice frame, said core panel having horizontal and vertical expanses bounding said frame-receiving opening and said horizontal and vertical expanses merging at corner regions disposed outwardly of corner extremities in said opening, the core panel being made of multiple veneer layers extending generally in the plane of the door and said layers being adhesively secured together, the veneer layers of the core panel at said corner regions including layers which are continuations of a vertical expanse and layers which are continuations of a horizontal expanse and said layers overlapping thus to integrate the core panel at said corner regions.

2. The door of claim 1, wherein the edge band strips have outer surfaces which are flat and extend normal to the plane of the door, and said core panel has edge surfaces defining said frame-receiving opening which are flat and extend normal to the plane of the door, said outer surfaces being slidable relative to said edge surfaces to enable mounting of the lattice frame within said frame-receiving opening.

3. The door of claim 2, wherein said inner frame pieces include horizontal pieces spanning said open area in a horizontal direction and vertical pieces spanning said open area in a vertical direction, and the ends of said vertical pieces are joined with said band of material through mortise and tenon joints.

4. The door of claim 2, wherein said edge band strips form a band of material extending in a rectangular course and having horizontal and vertical reaches, and said inner frame pieces include horizontal pieces spanning said open area and parallelling said horizontal reaches and vertical pieces spanning said open area and parallelling said vertical reaches, said pieces where one crosses with another being interconnected through an interfitting joint and said interfitting joint comprising rectangular cutouts and conforming snugly fitting webs in said pieces.

5. In a door or similar structure:

a rectangular lattice frame extending generally in a plane, the lattice frame comprising elongate vertical and elongate horizontal edge band strips forming the perimeter of the frame and bounding a generally open area, said edge band strips having opposed flat sides disposed generally normal to the plane of the frame, the lattice frame further comprising horizontal laterally spaced inner frame pieces extending parallel to the horizontal edge band strips and vertical laterally spaced inner frame pieces extending generally parallel to said vertical edge band strips, said vertical frame pieces crossing with the horizontal frame pieces and the vertical and horizontal pieces where they cross being joined through an interfitting joint and said interfitting joint comprising rectangular cutouts and conforming snugly fitting webs in said pieces, the vertical and horizontal frame pieces having opposed flat sides generally paralleling the sides of the edge band strips, the horizontal and vertical pieces collectively dividing said open area into multiple rectangular panel-receiving openings a core panel having a rectangular frame-receiving opening therein and said lattice frame being snugly received within said opening, the core panel and frame having equal widths and the core panel and frame extending in the same plane, a light-transmitting panel having one side and an opposite side mounted in respective ones of said panel-receiving openings, and a mounting for each light-transmitting panel within a panel-receiving opening comprising a first set of molding strips on one side of the light-transmitting panel and a second set of molding strips on the opposite side of the light-transmitting panel.

6. The door of claim 5, wherein the core panel is made of multiple veneer layers extending generally in the plane of the core panel said layers being adhesively secured together, the core panel having horizontal and vertical expanses joining at corner regions and the veneer layers in the corner regions including layers which are continuations of a vertical expanse and layers which are continuations of a horizontal expanse and said layers overlapping thus to integrate the core panel at said corner regions.

7. The door of claim 6 which further includes a veneer overlay extending in covering relation over each of opposite sides of the core panel, the veneer overlay extending to cover the edge band strips.

* * * * *